US010072820B2

(12) United States Patent
Gommans et al.

(10) Patent No.: US 10,072,820 B2
(45) Date of Patent: Sep. 11, 2018

(54) TUNABLE DAYLIGHT EXPERIENCE USING MICRO FACETED FOILS

(71) Applicant: PHILIPS LIGHTING HOLDING B.V., Eindhoven (NL)

(72) Inventors: Hendrikus Hubertus Petrus Gommans, Eindhoven (NL); Jochen Renaat Van Gheluwe, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/312,760

(22) PCT Filed: May 26, 2015

(86) PCT No.: PCT/EP2015/061558
§ 371 (c)(1),
(2) Date: Nov. 21, 2016

(87) PCT Pub. No.: WO2015/181149
PCT Pub. Date: Dec. 3, 2015

(65) Prior Publication Data

US 2017/0191637 A1 Jul. 6, 2017

(30) Foreign Application Priority Data

May 26, 2014 (EP) ..... 14169793

(51) Int. Cl.
*F21V 9/02* (2018.01)
*F21V 3/00* (2015.01)
(Continued)

(52) U.S. Cl.
CPC ..... *F21V 9/02* (2013.01); *F21V 3/00* (2013.01); *F21V 5/002* (2013.01); *F21V 5/045* (2013.01);
(Continued)

(58) Field of Classification Search
CPC . F21V 9/02; F21V 5/002; F21V 5/048; F21V 3/00; F21V 7/0091; F21Y 2115/10
See application file for complete search history.

(56) References Cited

U.S. PATENT DOCUMENTS 6,285,503 B1 9/2001 Chao et al.
2013/0270585 A1* 10/2013 Mei ..... H01L 25/0753 257/89

FOREIGN PATENT DOCUMENTS

CN 101072971 A 11/2007
EP 2725289 A2 4/2014
(Continued)

*Primary Examiner* — David V Bruce

(57) ABSTRACT

The invention provides a lighting unit (1) for providing daylight experience for a human. The lighting unit (1) comprises: a first light source (10) and a second light source (20) configured to provide light source light (11,21) having different spectral distributions, a light transmissive first light redistribution window (100) configured downstream of the first light source (10) and a light transmissive second light redistribution window (200) configured downstream of the second light source (20), a light transmissive redirection window (300) configured downstream of the first light redistribution window (100) and the second light redistribution window (200), and optionally a diffuser window (400) configured downstream of the light transmissive redirection window (400).

15 Claims, 7 Drawing Sheets

(51) Int. Cl.

| | |
|---|---|
| ***F21V 5/04*** | (2006.01) |
| ***F21V 7/00*** | (2006.01) |
| ***F21V 5/00*** | (2018.01) |
| *F21Y 115/10* | (2016.01) |

(52) U.S. Cl.
CPC ..... *F21V 7/0091* (2013.01); *F21Y 2115/10* (2016.08)

(56) References Cited

FOREIGN PATENT DOCUMENTS

| | | | |
|---|---|---|---|
| JP | 2002304903 | A | 10/2002 |
| WO | 2012092465 | A1 | 7/2012 |
| WO | 2013011410 | A1 | 1/2013 |
| WO | 2013011481 | A2 | 1/2013 |
| WO | 2013160796 | A2 | 10/2013 |
| WO | 2014030100 | A1 | 2/2014 |

* cited by examiner

TUNABLE DAYLIGHT EXPERIENCE USING MICRO FACETED FOILS

CROSS-REFERENCE TO PRIOR APPLICATIONS

This application is the U.S. National Phase application under 35 U.S.C. § 371 of International Application No. PCT/EP2015/061558, filed on May 26, 2015, which claims the benefit of European Patent Application No. 14169793.8, filed on May 26, 2014. These applications are hereby incorporated by reference herein.

FIELD OF THE INVENTION

The invention relates to a lighting unit comprising a plurality of light sources and a light transmissive window. The invention further relates to such lighting unit for use to provide daylight perception.

BACKGROUND OF THE INVENTION

The use of lighting units to simulate daylight or skylight is known in the art. WO2013011410, for instance, describes a lighting element used for obtaining a skylight appearance, which comprises a white light emitting means for emitting white light, a blue light emitting means for emitting blue light and a Fresnel lens. The Fresnel lens is arranged to receive light from the white light emitting means and from the blue light emitting means. The white light emitting means is arranged in a first relative position with respect to the Fresnel lens to collimate at least a part of the light emitted by the white light emitting means to obtain a collimated directed light beam in a specific direction. The blue light emitting means is arranged in a second relative position with respect to the Fresnel lens to obtain a blue light emission at least outside the collimated directed light beam.

SUMMARY OF THE INVENTION

People generally prefer daylight over artificial light as their primary source of illumination. The importance of daylight in our daily lives is generally recognized. Daylight is known to be important for people's health and wellbeing. As today, people in the western world spend about >90% of their time indoors and often away from natural daylight. Hence, there is a large opportunity for artificial daylight sources that create convincing daylight impressions with artificial light, in environments that lack natural daylight including homes, schools, shops, offices, hospital rooms, and bathrooms. Daylight appearance in general implies experiencing white light at a small viewing angle and experiencing blue or bluish light at a large viewing angle.

One of the main issues with presently known solutions is their low optical efficiency, which can easily be below 50%. This is mainly due to the fact that light absorbing optical elements are used, which e.g. selectively absorb the non-blue component of the light at larger angles. Other disadvantage of some prior art solutions is that the intensity of the 'blue sky' and the white downward light cannot be independently controlled. Yet another problem of prior art solutions is the relative large system of the essential optical elements. However, a practical requirement for such an artificial skylight solution is that it preferably should not be too deep, allowing easy integration in existing infrastructures. Other, previously considered solutions that can improve the optical efficiency of an artificial skylight concept typically lead to significantly thicker solutions, making them not practically viable.

A possible solution to independently control (dim) the blue sky and white light would be to use two LED colors (white and blue) where each color has a different optic (i.e. the white LEDs have an optic providing a relative narrow beam down and the blue LEDs have an optic providing a "hollow" beam (i.e. no light down, blue light under large angles). Such a solution would appear very spotty, which is less desired. This could be solved by using a weak diffuser. But to achieve a uniform appearance the diffuser would have to be placed at considerable distance from the led array. This might make the artificial skylight solution (again) impractically thick and bulky.

Hence, it is an aspect of the invention to provide an alternative lighting unit, which preferably further at least partly obviates one or more of above-described drawbacks. Especially, it is an aspect of the invention to provide an alternative lighting unit, and its use, which light is perceived as daylight or skylight, such as e.g. able to generate a white (central) beam, and blue beam, or at least bluer than the (central) white beam, at the side of such (central) beam, such as (entirely) surrounding such white (central) beam.

Herein, a solution is provided that may especially be based on a two foil micro-facetted design that significantly improves the optical efficiency. We propose to use different colored LEDs (of which one may provide white light) in combination with two foils with micro-facetted structures to mix and redistribute the light at the exit window, such that for instance a fine meshed checkerboard pattern is obtained that is perceived as uniform by the user. This allows the independent control of the angular intensity (i.e. beam shape) of each type of LED in an efficient manner.

Hence, in a first aspect, the invention provides a lighting unit ("unit" or "artificial skylight unit" or "artificial skylight device") comprising a first light source and a second light source (each) configured to provide light source light (but) having different spectral distributions, a light transmissive first light redistribution window ("first redistribution window" or "first upstream window") configured downstream of the first light source and a light transmissive second light redistribution window ("second redistribution window" or "second upstream window") configured downstream of the second light source, a light transmissive redirection window ("redirection window" or "downstream window") configured downstream of the first light redistribution window and the second light redistribution window, and optionally a diffuser window ("diffuser") configured downstream of the light transmissive redirection window, wherein: (i) the first light redistribution window is configured to redistribute first light source light of the first light source over the light transmissive redirection window to a plurality of first redirection regions of said light transmissive redirection window; and wherein the second redistribution window is configured to redistribute second light source light of the second light source also over the light transmissive redirection window to a plurality of second redirection regions of said light transmissive redirection window; and (ii) the first redirection regions of the light transmissive redirection window, optionally in combination with the diffuser window, are configured to shape at least part of the received first light source light into a first beam of light ("first beam"); and the second redirection regions of the light transmissive redirection window, optionally in combination with the diffuser window, are configured to shape at least part of the received second light source light into a second beam of light ("second beam"), wherein the first beam of light and the second beam of light do not overlap or only partly overlap, and wherein the first beam of light and the second beam of light have different spectral distributions.

With the present lighting unit, the optical efficiency is greatly improved compared to the solutions based on optical elements that use absorption (e.g. of non blue light for the generation of the large angle blue beam). Further, the present solution allows for an independent tuning between artificial blue skylight effect and the white light, which is not possible with many of the existing solutions. Especially, the exit window will appear uniform (giving uniform light), due to the redistribution of the light over the light transmissive redirection window, which is pleasant to the user. Also, the lighting unit only requires a small depth, which is desired in view of integrating the unit in existing structures. Especially, the lighting unit as described herein can be used in an indoor environment for providing daylight experience for a human. For instance, the lighting unit can be used in an indoor environment selected from the group consisting of a hospitality area (such as a hospital, an elderly home, a restaurant, etc.), and office area and a plant area, etc. However, other applications are also possible (see also below), such as in a shop, a shopping mall, etc.

Assuming e.g. a central white beam surrounded with blue light, the light emitted by the lighting unit may be perceived by a viewer as direct sunlight which falls through a skylight or a window on a sunny day. If the viewer looks towards the lighting unit from a position outside the white light beam, the viewer does (substantially) not see the white light of the light beam and the viewer may see the blue light (or another color, see below), which is comparable to the (blue) sky that a person sees when the viewer looks through a skylight from a position outside the beam of direct sunlight. Thus, the lighting unit may provide a skylight appearance which is experienced by users as pleasant lighting of an inner space of a building. When a person looks at the artificial skylight device under typical viewing angles (i.e. with the skylight build into the ceiling and the viewer is looking in around the room in an about horizontal direction), the skylights appear blue (as if looking through a window at a blue sky). The central white beam generated by the artificial skylight device however provides good quality white light illuminating all objects and people under (or near) the skylight with white light. Note that the angular extent of the white central beam are typically not angles under which people look into the skylight under normal circumstances (i.e. looking almost straight up).

When direct daylight, or artificial daylight emitted by the lighting unit of the invention, illuminates a room, the well-being of the people in the room may be positively influenced, and, for example, the productivity of the people may increase. The white light emitting means, herein indicated as first light source, emits white light, more in particular, light that is similar to white light. This means that the wavelength distribution of the white light is such that a color point of the white light is a color point on or close to a black body line of the color space. The human naked eye perceives light with a color point on the black body line as being in the range of cool-white to warm-white light. Direct sunlight is also white light and has a color point close to or on the blackbody line of the color space. Direct sunlight also varies, depending on the time of day and atmospheric conditions, between cool-white and warm-white. It is to be noted that this does not mean that the wavelength distribution is exactly the same as the wavelength distribution of direct sunlight. The light emitted by the white light emitting means may, for example, be a combination of some primary colors which, in said combination, result in a color point in the color space that is close to, or on, the black body line. The blue light has a spectral distribution in which wavelengths in the blue spectral range are dominant with respect to wavelengths outside the blue spectral range such that the human naked eye experiences the light as light of a blue color. Optionally, the blue light emission is in a plurality of light emission directions and at least a part of these light emission directions is outside the white light beam.

The first light source and the second light source are configured to generate first light source light and second light source light, respectively. The spectral distributions of the light of these light sources differ, such as white and blue light, respectively, or white and red light, respectively. Especially, the first light source light is white, and the second light source light is blue. However, optionally, the second light source light may also be orange or red, for instance to mimic sunset or sunrise conditions. Also the first light sources does not necessarily provide white. However, in specific embodiments the first light source provides white light source light. The term "light" source may optionally also refer to a plurality of light sources. However, when in a specific embodiment a plurality of light sources is applied as single first light source (like an RGB package) or as single second light source, the light emissive surfaces are arranged close to each other, such as within 2 mm (shortest distance). When a plurality of light sources is applied as first light source or as second light source, the light sources may optionally independently controllable (with the control unit, see also below). Further herein, the terms "plurality of first light sources" or "first light sources" and "plurality of second light sources" or "second light sources", and similar terms refer to lighting unit with a plurality of such sources that are arranged in an alternating arrangement (with a predetermined distance between neighboring light sources, see below), wherein the first light sources all substantially have the same spectral distribution, and wherein the second light sources all substantially have the same spectral distribution.

In a further specific embodiment, the first light source comprises a (solid state) light source, especially configured to provide blue (solid state) light source light, and a wavelength converter configured to convert part of the solid state light source light, especially thus the blue light into wavelength converter light having larger wavelength (such as green, yellow, orange and/or red), whereby the light source light comprises said solid state light source light and said wavelength converter light. In yet another embodiment, the first light source comprises an RGB solid state light source package. Hence, in a specific embodiment, the first light source comprises a solid state light source (such as a LED or laser diode). Especially, the first light source is configured to generate white light source light. Optionally, the first light source is a tunable light source, able to provide different colors (but in an embodiment at least including white light).

In a further specific embodiment, the second light source comprises a solid state light source. In a specific embodiment, the second light source is configured to provide light source light having a color selected of one or more of blue, green, yellow, amber, orange and red. Optionally, the second light source may be configured to provide two or more of such colors (e.g. a color tunable light source). Especially, the second light source is at least configured to provide blue (solid state) light source light. Hence, in a specific embodiment, the second light source comprises a solid state light source (such as a LED or laser diode). Optionally, the second light source is a tunable light source, able to provide different colors (but in an embodiment at least including blue and/or red light, especially at least blue light).

Especially, the first light source and the second light source are configured to generate light having different spectral distributions, i.e. the spectra do not fully coincide over the entire (visible) wavelength range. For instance, the first light source generates white light (including blue light), whereas the second light source substantially generates blue light (i.e. substantially no light in the other spectral wavelength ranges than the blue range, such as substantially no green, yellow and red light). In the blue spectral region the spectra might coincide, but in the other spectral regions, there is substantially less or no coincidence. Hence, the spectral distributions do not coincide, but only partly coincide. Hence, the first and the second light source are able to provide light having different spectral distributions, and may only partly coincide. Especially, the first light source light and second light source light have different color points. Hence, in a specific embodiment the first light source is configured to generate white first light source light and the second light source is configured to provide one or more of blue and red second light source light. Especially, the lighting unit may further comprise a control unit, configured to control the first light source and the second light source independently. The control unit may be configured to be controlled by e.g. one or more of a remote control unit and a sensor, such as an external light sensor, or a sensor configured to sense human behavior, or a time sensor, etc. By individually controlling the first and the second light source, daylight experience may be tuned, e.g. as function of time and/or of user setting, etc. Note that when there are a plurality of first light sources and a plurality of second light sources, the control unit may especially be configured to control the plurality of first light sources independently from the plurality of second light sources.

The invention is herein explained with reference to a unit comprising (i) a first light source and a first light redistribution window, and (i) a second light source and a second light redistribution window. Optionally, the lighting unit may comprise more than two of such units, each redistributing their light over the redirection window. Alternatively or additionally, the lighting unit comprises a plurality of units each including a first light source and a first light redistribution window, a second light source and a second light redistribution window, and their (shared) redirection window, over which these light sources redistribute their light source light. In such instance, a single redistribution window may be used, with different redistribution regions for the individual light sources.

In a specific embodiment, the first light source and the second light source are arranged at a light source distance (LD) selected from the range of 5-200 mm, especially in the range of 10-100 mm, such as 10-50 mm. With shorter or longer distances (between nearest neighbors), the required distribution over the light transmissive redirection window and/or the desired angles of the two beams cannot easily be obtained. The light source distance is especially the shortest distance between adjacent light sources. This distance may especially be measured between the light emitting surfaces of the light sources. As the light emissive surfaces are in general small (dimensions like width and length≤2 mm), instead of the shortest distance, also the pitch may be used.

As indicated above, the terms "first light source" and/or "second light source" may refer to a plurality of first light sources and/or second light sources, respectively. Hence, when upstream of the redistribution window a plurality of first light sources and second light sources is configured, the light source distances (LD) are selected from the range of 5-200 mm, especially in the range of 10-100 mm. This relates, as indicated above, to the shortest distance between nearest neighbor light sources. The arrangement of the first light sources and second light sources is especially alternating. Hence, (also) the first light sources and the second light source may be arranged in a checkerboard pattern. However, other patterns, like a hexagonal arrangement, etc. may also be possible. Especially, however, the first and the second light sources form a regular pattern with shortest distances between neighboring light sources of 5-200 mm, as indicated above. In a very specific embodiment, one or more of the first light source and the second light source, independently consist of two or more subsets of light sources having different spectral distributions but together providing the first light source light having a first spectral distribution and the second light source light having a second spectral distribution, respectively. In such instance, the light source distances may especially be in the range of about 5-50 mm, even more especially 5-20 mm, in order to guarantee an exit window showing homogeneous light. For the sake of simplicity, the invention is herein further described with reference to the first light source(s) and the second light source(s), each substantially including a singly type of first light sources and second light sources, respectively.

Downstream of each of the two (types of) light sources light transmissive redistribution windows are arranged, which are indicated as first light transmissive redistribution window and second light transmissive redistribution window, respectively. These windows are herein also indicated as (first and second) upstream window, because these windows are arranged upstream of the redirection window. Note that optionally between the upstream window(s) and the redirection widow one or more further windows and/or other optics may be arranged.

The terms "upstream" and "downstream" relate to an arrangement of items or features relative to the propagation of the light from a light generating means (here the especially the light source(s)), wherein relative to a first position within a beam of light from the light generating means, a second position in the beam of light closer to the light generating means is "upstream", and a third position within the beam of light further away from the light generating means is "downstream".

The redistribution windows may be a single window, but with two parts dedicated for each light source. However, also separate windows may be applied. In general, the distance between the redistribution window(s) and the light sources is the same for both the combination of the fist light source and the first redistribution window and the second light source and the second redistribution window (see further also below). Herein, the invention is further explained with reference to the first and the second redistribution window, though this may be a single window with two parts (redistribution regions) associated with the respective light sources. When a plurality of first light sources and a plurality of second light sources are applied, the redistribution windows will especially be arranged in a corresponding arrangement, i.e. a light source checker board arrangement and a redistribution window checker board arrangement.

Further, the lighting unit comprises a light transmissive redirection window configured downstream of the first light redistribution window and the second light redistribution window. Hence, this redirection window is in general a single window, which receives light source light from both light sources (see also below). The redirection window is herein also indicated as downstream window as it is arranged downstream of the redistribution windows. The redirection window may in embodiments be configured as exit window; however, downstream of the redirection window optionally one or more further windows and/or other optics may be arranged.

The redirection window comprises a plurality of redirection regions, which can be distinguished between first redirection regions and second redirection regions. These redirection regions are distributed over, especially the entire, redirection window. Hence, the about half of the total number of first redirection regions will be configured downstream of the second light source, and about half of the total number of second redirection regions will be configured downstream of the first light source. The first redirection regions receive via the redistribution window light source light from substantially only the first light source and the second redirection regions receive via the redistribution window light source light from substantially only the second light source.

Hence, the first light redistribution window is configured to redistribute first light source light of the first light source over the light transmissive redirection window to a plurality of first redirection regions of said light transmissive redirection window. Further, the second redistribution window is configured to redistribute second light source light of the second light source also over the light transmissive redirection window to a plurality of second redirection regions of said light transmissive redirection window. The redistribution window is thus configured to redistribute the light source light of the first and the second light source over substantially the entire redirection window, though substantially only to the first and second redirection regions, respectively. The redistribution windows are especially configured, in combination with the respective light source(s), to homogeneously distribute the light over the respective redirection regions.

To this end, the redistribution windows include micro facets or optical structures with micro facets, see further also below. Hence, especially the light transmissive first light redistribution window may comprise first redistribution optical elements and the light transmissive second light redistribution window may comprise second redistribution optical elements, such as these micro facets or optical structures with micro facets.

Hence, in a first stage, the light source light of the first light source and of the second light source is deflected in such ways, that the light thereof is redistributed over the redirection window, with first redirection regions substantially only receiving first light source light and second redirection regions substantially only receiving second light source light. In an embodiment, the first redirection regions and the second redirection regions are configured in a (2D) arrangement wherein the regions alternate (over the entire redirection window). For instance, in a specific embodiment the first redirection regions and the second redirection regions are configured in a checkerboard pattern (over the entire redirection window). However, other patterns, like a hexagonal arrangement, etc. may also be possible. Especially, however, the first redirection regions and the second light redirection regions form a regular pattern, with especially the regions having the herein indicated areas (see also below). Note that in embodiment wherein a plurality of first light sources and second light sources, the arrangement of the redirection regions is not necessarily of the same symmetry as the arrangement of the light sources. For instance, the light sources may be arranged in a cubic symmetry arrangement whereas the redirection regions may have hexagonal symmetry. The way how the redistribution window(s) redistribute the light source light over the redirection window can (accordingly) be chosen.

The redirection regions should have dimension that allow providing a substantially homogeneous light distribution appearance over the window for a viewer. Hence, the dimensions should not be too large, as a viewer might than perceive darker and brighter regions, which is not desired. On the other hand, for instance in view of the beam spread of the light source light, the redirection regions may also not be small. In a specific embodiment, the first redirection regions and the second redirection region have cross-sectional areas of less than 2,000 $mm^2$, especially the first redirection regions and the second redirection region having cross-sectional areas of less than 20 $mm^2$. Especially, the redirection regions have a cross-sectional area in the range of at least 1 $mm^2$, especially at least 4 $mm^2$, such as in the range of 1-2000 $mm^2$, like in the range of 4-400 $mm^2$. The cross-sectional area especially relates to the surface area of the region with the one or more redirection elements (micro facets), as would it a flat region. Hence, the cross-sectional area relates to the area of a cross-section parallel to the plane of the window. For instance, a 100 $cm^2$ window may include 10,000 regions each having a cross-sectional area of 1 $mm^2$, as 10,000*1 $mm^2$ equals to 100 $cm^2$. Hence, the term cross-sectional area may also relate to the surface area, not taking into account the surface irregularities due to the facets, but only using the surface area parallel to a plane through the window.

The fact that the exit window of the device (appears) homogeneous or uniform is an important benefit of the invention (compared to other more standard technical solutions). This is achieved by the combination of the light sources and the redirection window and the dimensions of the redirection regions. The redistribution window distributes the light source light over the respective redirection regions, and as these regions have dimensions that are not too large, and alternate with other regions, a viewer will perceive the a homogeneous emitting exit window (i.e. with a substantially even intensity over the exit window).

The redirection window is especially arranged to provide essentially two types of beams: the first beam of light, (essentially) based on the light from the first light source, but now escaping from the entire redirection window, and the second beam of light, (essentially) based on the light from the second light source, and also escaping from the entire redirection window. However, these beams escape in different directions. In this way, the first beam of light and the second beam of light do not overlap or only partly overlap, and the first beam of light and the second beam of light have different spectral distributions. Light with different spectral distributions, like white light from the first light source and blue (or red) light from the second light source, escape under a mutual (non-zero) angle. Hence, the lighting unit is configured that in the far field, such as at a distance of an exit window of the lighting unit of at least 5 m, the beams will illuminate areas that partly overlap or that do not overlap.

To this end, the redirection window also includes micro facets or optical structures with micro facets, see further also below. Hence, each first redirection region may comprise one or more first redirection optical elements, and each second redirection region may comprise one or more second redirection optical elements, such as these micro facets or optical structures with micro facets. Note that the redirection region(s) directly over e.g. the first light source may not include micro facets, as the first light source light may have to travel straight, although for broadening of the beam (see also below), such micro facets may still be present also in such redirection region.

The first and the second beam may be imposed a specific opening angle. This may be imposed by the arrangement of the facets (especially at the redirection window). For instance, two substantial parallel first light source rays may be received and/or escape from facets with slightly different base angles (of the facets). Thereby, beam width is introduced and a desired opening angle of the beam may be generated.

Further, especially the redirection window is configured to provide said first beam of light having an opening angle of 120° or less. The final beam, emanating from the lighting device thus especially has an opening angle of 120° or less. Hence, there may be no substantial glare. The opening angle may also be smaller, like 90°, or less. The opening angle is especially defined with respect to the full width half maximum (FWHM) of the beam(s).

In addition to the use of micro facets to tune the beam angle, or alternative thereto, optionally the lighting unit further comprises a diffuser window ("diffuser") configured downstream of the light transmissive redirection window. In a specific embodiment, said diffuser window is applied, and the diffuser window has a full width half maximum (FWHM) selected from the range up to 30°, such as at least 5°. For instance, a holographic diffuser with FWHM of 5-20°, like 5-10° may be applied. For instance, holographic diffusers or other engineered diffusers, i.e. diffusers engineered to diffuse the incident light over a defined angular range, may be used. Holographic diffusers are known in the art, and are e.g. described in WO2012092465, U.S. Pat. No. 6,285,503, etc. Hence, especially the redirection window is configured to provide, optionally in combination with the optional diffuser window, said first beam of light having an opening angle of 120° or less.

Optionally, between the redirection window and the diffuser window, one or more further windows and/or other optics may be arranged. Further, the diffuser window may be configured as exit window. However, downstream of the diffuser window optionally one or more further windows and/or other optics may be arranged.

Both the redistribution windows, and the redirection window, are especially configured in the transmissive mode. Hence, light from the light sources pass these windows. Especially, the windows (redistribution windows, redirection window, and optionally the diffuser window) comprise foils. Also the diffuser window may be a foil. Foils can be very thin and can e.g. easily be stretched between walls of a light chamber. In an embodiment, the term "window" refers to a self-supporting (transmissive) element. The window especially comprises material that is transmissive for visible light. Hence, the window is light transmissive. This applies to the redistribution windows, redirection window, and also the optional further windows, and also the optional diffuser window.

The total thickness of the windows(s) (or foils), especially the redistribution windows and the redirection window, may be in the range of 0.2-20 mm, especially 0.2-5 mm, including the optical elements. The window(s) may have cross-sectional areas in the range of 4 $mm^2$ 50 $m^2$, although even larger may be possible. In a specific embodiment, the total cross-sectional areas of the both redistribution windows are substantially equal to the cross-sectional area of the redirection window. Also tiles of windows, arranged adjacent to each other, may be applied. The windows are transmissive, i.e. at least part of the light, especially at least part of the visible light illuminating one side of the window, i.e. especially the upstream side, passes through the window, and emanates from the window at the downstream side. This results eventually in the lighting unit light. Especially, the windows comprise, even more especially substantially consist of, a polymeric material, especially one or more materials selected from the group consisting of PE (polyethylene), PP (polypropylene), PEN (polyethylene napthalate), PC (polycarbonate), polymethylacrylate (PMA), polymethylmethacrylate (PMMA) (Plexiglas or Perspex), cellulose acetate butyrate (CAB), silicone, polyvinylchloride (PVC), polyethylene terephthalate (PET), (PETG) (glycol modified polyethylene terephthalate), PDMS (polydimethylsiloxane), and COC (cyclo olefin copolymer). However, other (co) polymers may also be possible. Hence, also the window regions of the respective windows are transmissive for at least part of the light of the light source(s). In a specific embodiment, the first light redistribution window, the second light redistribution window, and the redirection window comprise polymeric foils.

Further, as indicated above, each of the redistribution windows and redirection window may comprise micro optical structures. Micro-optical structures and solid state light sources appear to provide a good combination that can be used for such alternative lighting unit. The optical structures may e.g. be obtainable by laser ablation or by 3D printing (of transparent material; see also below), etc. Hence, the optical elements may comprise two or more facets, with at least two facets having a mutual angle (η). Further, the optical elements have a height and a width. The optical structures may be arranged in a regular array or an irregular array or a combination thereof.

The optical structures may include optical structures that are configured to couple light out after total internal reflection (TIR) (and then refraction). Alternatively or additionally, optical structures may include optical structures that are configured to (directly) couple light out after refraction. Hence, the redistribution and redirection properties may especially be provided by optical structures that impose total internal reflection to the light source light, and provide lighting device light after outcoupling via refraction of the light source light after internal reflection. Alternatively or additionally, the redistribution and redirection properties may especially be provided by optical structures that impose refraction to the light source light without previous reflection within the optical structure, and (thus) provide lighting device light after outcoupling via (only) refraction of the light source light. The former structures are herein also indicated as TIR structures, wherein the latter are herein also indicated as refractive structures. Hence, TIR optical structures may also be indicated as TIR+refraction optical structures. As indicated below, an optical structure may also provide both effects, dependent upon the base angles of the facets of the optical structures.

The optical structures, as indicated above, may have different facets. Hence, a single optical structure may in embodiments also provide via one facet outcoupling via (first) TIR and via another facet outcoupling via (direct) refraction. Especially, the optical structures provide at least the function of outcoupling via total internal reflection (especially at larger distances from the optical axis of the light source, such as at a distance at least equaling the distance from the transmissive window to the light source). As in such embodiments the facets may be relatively steep, though still a large beam opening angle range of the lighting device beam can be chosen. For instance in the case of one of the windows being made of polycarbonate, facets having base angles in the range of about 50°-80°, such as in the range of 50°-70°, can provide (via TIR) beams having opening angles in the range of >2*0° up to 2*80°. Especially, the base angles are selected from the range of 10°-80°, such as 10°-70°. This will also further be discussed below. Especially, the opening angle (of the thus obtained beam) is equal to or less than 2*65° in view of glare reduction, especially in offices, even more especially equal to or less than 2*60°.

Especially, the optical elements have one or more of a refractive functionality and total internal reflection functionality to the light source light. Of course, both types of functionalities may be available. Further, as indicated above, elements may have both functionalities. For instance, a face may provide refraction only and another face shows refraction as subsequent effect on reflection at another face. In yet a further specific embodiment the optical elements especially have prismatic shapes having one or more dimensions especially in the range of 0.01-5 mm.

Each window comprises a plurality of optical elements. These optical elements may especially comprise one or more of prismatic elements, lenses, total internal reflection (TIR) elements, refractive elements, facetted elements. The optical elements may be embedded in the window, and may especially be part of a window side (or face), such as especially a downstream side or an upstream side, or both the downstream and upstream side. Herein, the optical elements are especially further described in relation to optical elements having a Fresnel or refractive function and optical elements having a total internal reflection function. Each optical element may comprise one or more facets. The optical elements (including facets) may be arranged at an upstream side or a downstream side or both the upstream side and downstream side of the windows. Especially, TIR elements are especially available at an upstream side of the windows, whereas the refractive elements, such as Fresnel lenses, may be arranged at the upstream and/or downstream side of the windows.

One or more of the dimensions of the facets (of these elements), especially of the TIR elements, like height, width, length, etc., may in embodiments be equal to or below 5 mm, especially in the range of 0.01-5, such as below 2 mm, like below 1.5 mm, especially in the range of 0.01-1 mm. The diameters of the refractive Fresnel lenses may in embodiments be in the range of 0.02-50 mm, such as 0.5-40 mm, like 1-30 mm, though less than 30 mm may thus (also) be possible, like equal to or smaller than 5 mm, such as 0.1-5 mm. The height of these facets will also in embodiments be below 5 mm, such as below 2 mm, like below 1.5 mm, especially in the range of 0.01-1 mm. Here the term "facet", especially in TIR embodiments, may refer to a (substantially) flat (small) faces, whereas the term "facet", especially in Fresnel embodiments, may refer to curved faces. Thus curvature may especially be in the plane of the window, but also perpendicular to the plane of the window ("lens"). The Fresnel lenses are not necessarily round, they may also have distorted round shapes or other shapes.

The prismatic shapes or elements may essentially comprise two (substantially flat) facets arranged under an angle ($\eta$) with each other and especially arranged under angle (base angle) (>0° and ≤90° relative to a plane through the window).

In a specific embodiment, the first light redistribution window the light transmissive second light redistribution window independently comprise Fresnel lenses, and the first redirection regions and the second redirection regions independently comprise at least part of Fresnel lenses. In a further embodiment, the first light redistribution window the light transmissive second light redistribution window independently comprise prismatic elements, and the first redirection regions and the second redirection regions independently comprise prismatic elements. Hence, both (i) the redistribution window(s) and (ii) the redirection window may include one or more of (part of) Fresnel lenses and prismatic structures. Other optical elements than prismatic structures may also be possible. Hence, the optical structures may include one or more of structures with square facets, structures with hexagonal facets, cones, prisms (using refraction), lenslets (using refraction), or other structures that use one or more of (total internal) reflection and refraction. For instance, cylindrical lens segments (like Fresnel lenses) or free shape lens segments may be included.

The phrase "the first redirection regions and the second redirection regions independently comprise at least part of Fresnel lenses" amongst others refers to the fact that the first and the second redirection regions alternate, and thus the Fresnel lens in the redirection window associated with a first light source structure may be distributed over a plurality of first redirection regions, which first redirection regions alternate with second redirection regions, thereby creating a Fresnel parts that are interrupted with second redirection regions. This may also be the other way around for the redirection regions associated with the second light source.

Hence, in this way with the redistribution windows and the redirection window, and the optional diffuser window, the first redirection regions of the light transmissive redirection window, optionally in combination with the (optional) diffuser window, are configured to shape at least part of the received first light source light into a first beam of light ("first beam"); and the second redirection regions of the light transmissive redirection window, optionally in combination with the (optional) diffuser window, are configured to shape at least part of the received second light source light into a second beam of light ("second beam"), wherein the first beam of light and the second beam of light do not overlap or only partly overlap, and the first beam of light and the second beam of light have different spectral distributions. When for instance the first beam is white light, and the second beam is a hollow beam surrounding the first beam, and the second beam is blue light (and/or red light), the above indicated skylight experience may be provided with the presently proposed lighting unit.

In a specific embodiment, the first redirection regions of the light transmissive redirection window, optionally in combination with the optional diffuser window, are configured to provide ((when seen) in a cross-sectional view) said first beam of light having a first optical axis (O1) and having a first opening angle ($\theta$1) selected from the range of 60-150°, such as 120°. Further, in an embodiment the second redirection regions of the light transmissive redirection window, optionally in combination with the diffuser window, are configured to provide ((when seen) in a cross-sectional view) said second beam of light having second optical axis (O2) and having a second opening angle ($\theta$2) selected from the range of 5–60°. Especially, the first optical axis (O1) of the first beam of light, and the second optical axis (O2) of the second beam of light, have ((when seen) in a cross-sectional view) a mutual angle ($\gamma$) selected from the range of 45–90°. In this way, two beams are obtained downstream from the redirection window or optional diffuser, which escape under different angles. As indicated above, in an embodiment the first beam is white light, and the second beam is a hollow beam surrounding the first beam, and the second beam is blue light (and/or red light).

In a further specific embodiment, the light transmissive first light redistribution window comprises first redistribution optical elements, the light transmissive second light redistribution window comprises second redistribution optical elements; each first redirection region comprises one or more first redirection optical elements, and each second redirection region comprises one or more second redirection optical elements; the first redistribution optical elements are configured to redirect the first light source light to the plurality of first redirection regions, the second redistribution optical elements are configured to redirect the second light source light to the plurality of second redirection regions, the first redirection optical elements optionally in combination with the optional diffuser window are configured to provide said first beam of light having a first optical axis (O1) and having a first opening angle (θ1) selected from the range of 60-150°, the second redirection optical elements are configured to provide said second beam of light having second optical axis (O2) and having a second opening angle (θ2) selected from the range of 5-60°.

It further appears that for best optical properties, especially the first redistribution optical elements, the second redistribution optical elements, the first redirection optical elements, and the second redirection optical elements comprise optical elements with facets (f) having facet heights (fh) selected from the range of 10-5,000 μm and have base angles (a) of the facets (f) with a base plane of the layers (100,200,300) independently selected from the range of 50-80° and 10-40°.

Also, the respective windows may not be arranged too close or too far away from the light sources (in the case of the redistribution window) and too close or to far away from the redistribution window (in the case of the redirection window). As already indicated above, the distance of the light sources is especially selected from the range of 5-200 mm, such as 10-100 mm. Further, especially the first light redistribution window and the second light redistribution window are arranged at a first distance (d1) selected from the range of 1-50 mm of the respective light sources. It also appears desired in view of the optical properties that the redirection window is arranged at a second distance (d2) selected from the range of 1-200 mm of the first light redistribution window and the second light redistribution window. Especially the first light redistribution window and the second light redistribution window each have a cross-sectional area selected from the range of 25-40,000 $mm^2$. As indicated above, especially the light sources are solid state light sources. Small light emitting surfaces are desired in view of the optical properties. Hence, especially the first light source and the second light source are (solid state) light sources having light emitting surfaces (such as LED dies) having areas selected from the range of 0.25-100 $mm^2$.

Hence, in a specific embodiment the invention provides a lighting unit comprising a first light source, a second light source, a light transmissive first light redistribution window, a light transmissive redirection window, and optionally a diffuser window, wherein (i) the first light source is configured to generate first light source light having a first spectral distribution, and the second light source is configured to generate second light source light having a second spectral distribution differing from the first spectral distribution, wherein (a) the light transmissive first light redistribution window comprises first redistribution optical elements, and wherein the light transmissive first light redistribution window is configured downstream of the first light source; and wherein the light transmissive second light redistribution window comprises second redistribution optical elements, and wherein the light transmissive second light redistribution window is configured downstream of the second light source; (b) the light transmissive redirection window is configured downstream of the first light redistribution window and the second light redistribution window, wherein the redirection window comprises a plurality of first redirection regions and a plurality of second redirection regions, each first redirection region comprising one or more first redirection optical elements, and each second redirection region comprising one or more second redirection optical elements, wherein the first redirection regions and the second redirection regions are configured in a (2D) arrangement wherein the regions alternate; (c) the optional diffuser window is configured downstream of the light transmissive redirection window; (d) the first redistribution optical elements are configured to redirect the first light source light to the plurality of first redirection regions, the second redistribution optical elements are configured to redirect the second light source light to the plurality of second redirection regions, wherein the first redirection optical elements optionally in combination with the optional diffuser window are configured to shape at least part of the received first light source light into a first beam of light having a first optical axis (O1) and having a first opening angle (θ1) especially selected from the range of 60-150°, wherein the second redirection optical elements are configured to shape at least part of the received second light source light into a second beam of light having second optical axis (O2) and having a second opening angle (θ2) especially selected from the range of 5-60°, and wherein the first optical axis (O1) and the second optical axis (O2) have a mutual angle (γ) especially selected from the range of 45-90°.

The phrase "wherein the first optical axis (O1) and the second optical axis (O2) have a mutual angle (γ) selected from the range of 45-90°" especially refers to such angles between the optical axes in a cross-sectional plane through the beams, with the cross-sectional plane being arranged parallel with the first optical axis, and the first optical axis also being contained by this cross-sectional plane. Hence, the second beam may also be defined with respect to the first optical axis, as being found within an angle of ≥30° relative to the first optical axis, even more especially ≥45°, yet even more especially ≥60°, but especially ≤90°. In an embodiment wherein a centro symmetric beam is created, the central beam, the first beam is surrounded by the second beam, with the latter at angles of at least 30° relative to the first optical axis of the first beam. Hence, the second beam is especially a beam having a beam width in the range of up to 60° and having an angle relative to the first optical axis in the range of 30-90°, such as 45-90° (with in such embodiment the beam having a beam width in the range of up to 45°).

Above, the lighting unit is amongst others described in relation to the first light source and the second light source. However, there may be a plurality of first light sources and a plurality of second light sources. This may allow an easier distribution of the first light source light and the second light source light, as in the case of only two light sources, both light sources especially have to illuminate the entire redirection window (via the redistribution windows), whereas when more light sources are used, this task may be shared by the plurality of light sources. Each redistribution window may be used to illuminate the downstream arranged part of the redirection window, and part of an adjacent part of the redirection window arranged downstream from the redistribution window of an adjacent other light source.

Hence, in a further embodiment the invention provides the lighting unit as defined herein, comprising a plurality of first light sources and a plurality of second light sources, wherein downstream from each first light source the first light redistribution window is configured, wherein downstream from each second light source the second light redistribution window is configured, wherein downstream of each of the first light distribution window a first part of the light transmissive redirection window is configured, wherein downstream of each of the second light distribution window a second part of the light transmissive redirection window is configured, wherein each first part and second part comprises a plurality of redirection regions, wherein first light sources and first light distribution windows are configured to redistribute the first light source light over their first part of the light transmissive redirection window and also at part of one or more adjacent second parts of the light transmissive redirection window, and wherein second light sources and second light distribution windows are configured to redistribute the second light source light over their second part of the light transmissive redirection window and also at part of one or more adjacent first parts of the light transmissive redirection window. Especially, the first light sources and the second light sources are configured in a (2D) arrangement wherein the light sources alternate. As indicated above, (also) the first light sources and the second light source may be arranged in a checkerboard pattern, or another pattern, like a hexagonal arrangement, etc. Especially, the first and the second light sources form a regular pattern with shortest distances between neighboring light sources of 5-200 mm, as indicated above.

Especially, in this way the first light sources and the second light sources in combination with the redistribution windows are configured to illuminate the redirection window homogeneously. For instance, this may especially be used when the (first or second) redistribution window is arranged within a cone of about 60° along the optical axis from the (first or second) light source. As indicated above, the cross-sectional area of the (first or second) redistribution window and the cross-sectional area of the associated downstream arranged part of the redirection are substantially the same. With the redistribution window arranged within said cone, and with the redirection window part being about the same size as the associated redistribution window, the redistribution window may illuminate the associated redirection window part as well as parts of adjacent redirection window parts.

The lighting device may be part of or may be applied in e.g. office lighting systems, household application systems, shop lighting systems, home lighting systems, theater lighting systems, green house lighting systems, horticulture lighting, etc.

The term white light herein, is known to the person skilled in the art. It especially relates to light having a correlated color temperature (CCT) between about 2000 and 20000 K, especially 2700-20000 K, for general lighting especially in the range of about 2700 K and 6500 K, and for backlighting purposes especially in the range of about 7000 K and 20000 K, and especially within about 15 SDCM (standard deviation of color matching) from the BBL (black body locus), especially within about 10 SDCM from the BBL, even more especially within about 5 SDCM from the BBL.

The terms "violet light" or "violet emission" especially relates to light having a wavelength in the range of about 380-440 nm. The terms "blue light" or "blue emission" especially relates to light having a wavelength in the range of about 440-490 nm (including some violet and cyan hues). The terms "green light" or "green emission", including blue-green, especially relate to light having a wavelength in the range of about 490-560 nm. The terms "yellow light" or "yellow emission" especially relate to light having a wavelength in the range of about 540-570 nm. The terms "orange light" or "orange emission" especially relate to light having a wavelength in the range of about 570-600. The terms "red light" or "red emission" especially relate to light having a wavelength in the range of about 600-750 nm. The term "pink light" or "pink emission" refers to light having a blue and a red component. The terms "visible", "visible light" or "visible emission" refer to light having a wavelength in the range of about 380-750 nm.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Furthermore, some of the features can form the basis for one or more divisional applications.

BRIEF DESCRIPTION OF THE DRAWINGS

Embodiments of the invention will now be described, by way of example only, with reference to the accompanying schematic drawings in which corresponding reference symbols indicate corresponding parts, and in which.

The drawings are not necessarily on scale.

DETAILED DESCRIPTION OF THE EMBODIMENTS

Figure 1A:
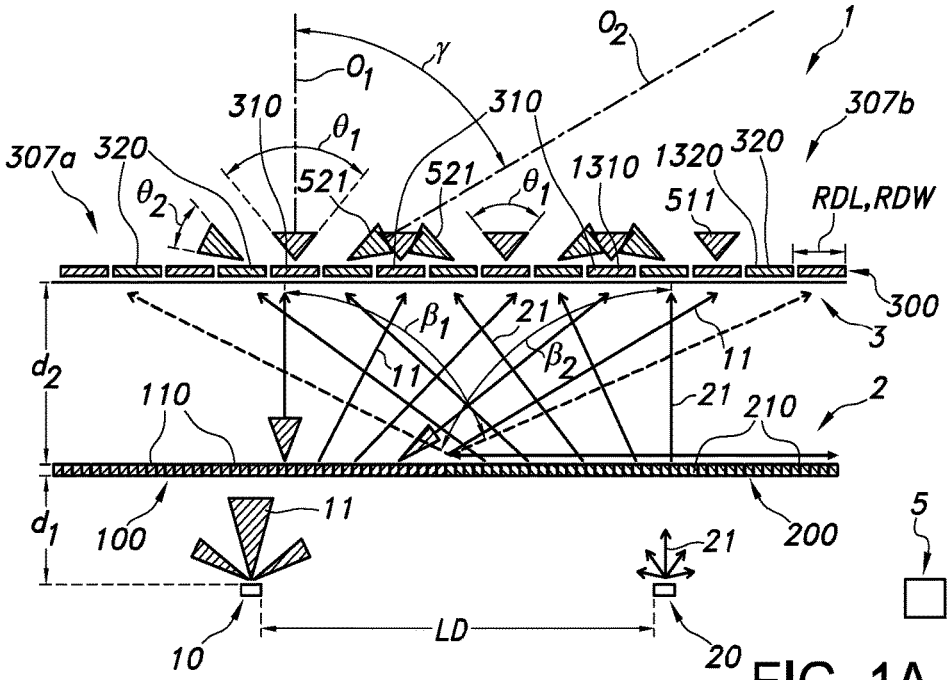
FIGS. 1A-1F schematically depicts some embodiments and aspects of the lighting unit.
Figure 1B:
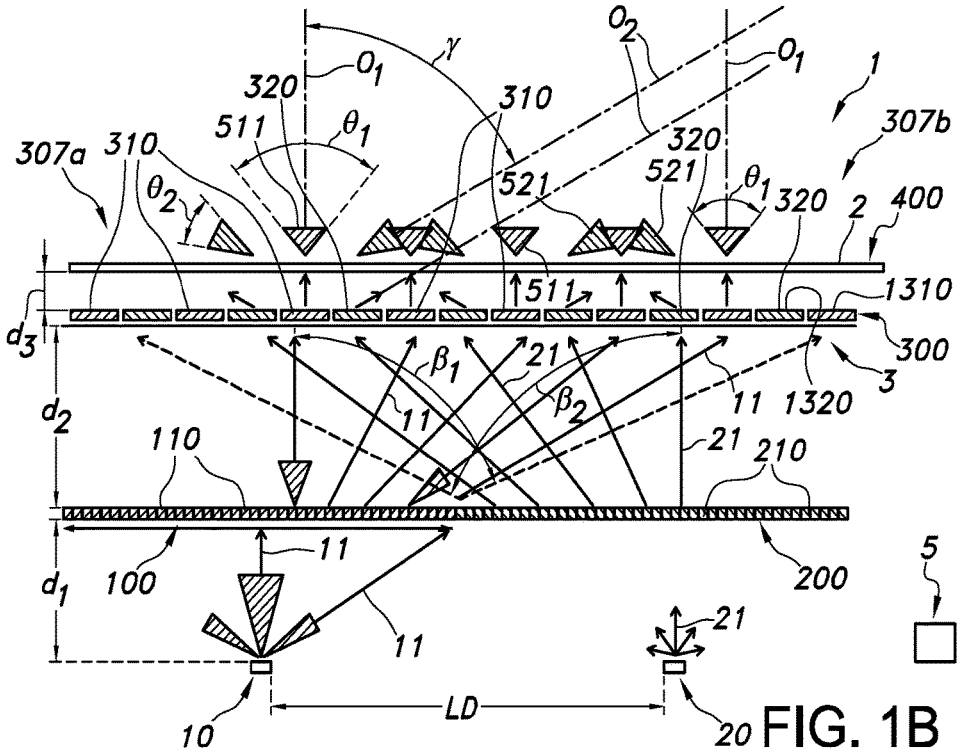

A first embodiment may comprise two micro facetted foils as depicted FIG. 1A. In this embodiment we use two different colored LEDs (e.g. white and blue). This figures show a lighting unit 1 comprising a first light source 10 and a second light source 20 configured to provide light source light 11,21 having different spectral distributions. Further, the lighting unit 1 comprises a light transmissive first light redistribution window 100 configured downstream of the first light source 10 and a light transmissive second light redistribution window 200 configured downstream of the second light source 20. Further, the lighting unit 1 comprises a light transmissive redirection window 300 configured downstream of the first light redistribution window 100 and the second light redistribution window 200, and optionally a diffuser window 400 configured downstream of the light transmissive redirection window 400, as schematically depicted in FIG. 1B. The redirection window 300, or the optional diffuser window 400 may be configured as exit window, respectively. Optionally however, further windows may be configured downstream of one of these windows. The redistribution windows 100,200 may be a single window with redistribution regions, dedicated to the respective first light source 10 and second light source 20.

The first light redistribution window 100 is configured to redistribute first light source light 11 of the first light source 10 over the light transmissive redirection window 300 to a plurality of first redirection regions 310 of said light transmissive redirection window 300. Also the second redistribution window 200 is configured to redistribute second light source light 21 of the second light source 20 also over the light transmissive redirection window 300 to a plurality of second redirection regions 320 of said light transmissive redirection window 300. To this end, the first redistribution window 100 comprises redistribution optical elements, such as prismatic structures and/or Fresnel lenses, and the second redistribution window 200 comprises redistribution optical elements, such as prismatic structures and/or Fresnel lenses. In this way, the first light source light 11 and the second light source light 21 is distributed of the respective regions which are distributed over the entire redirection window. A part 307 of the redirection window 300 associated with the first redistribution window 100 is indicated with reference 307 (first part); the part of the redirection window 300 associated with the second redistribution window 200 is indicated with reference 307*b* (second part). Note that the cross-sectional areas of these parts may be substantially the same. Note further that the cross-sectional areas of these parts and the cross-sectional areas of the relevant windows are especially also the same. Note that each light source may also illuminate part of the adjacent redirection window part 307. In case of two light source, both light sources may illuminate the entire redirection window (i.e. the relevant first and second regions thereof).

The first redirection regions 310 of the light transmissive redirection window 300, optionally in combination with the diffuser window 400 (see further below), are configured to shape at least part of the received first light source light into a first beam of light 511; the second redirection regions 320 of the light transmissive redirection window 300, optionally in combination with the diffuser window 400 (see further below), are configured to shape at least part of the received second light source light into a second beam of light 521. The individual optical elements of the redirection regions 310,320 are not visible. However, for the sake of completeness these are indicated in FIGS. 1A and 1B with references 1310 and 1320, respectively. The first redirection regions 310 and the second redirection regions 320 may have dimensions like length, indicated with RDL, and width, indicated with RDW in the order of a few mm. Note that these regions are not necessarily square, but may e.g. also be hexagonal.

As shown in the figure(s), the first beam of light 511 and the second beam of light 521 do not overlap or only partly overlap. Further, the first beam of light 511 and the second beam of light 521 have different spectral distributions, due to the fact that the spectral distributions of the light source light of the light sources 10,20 differ. The opening angle of the first beam and the second beam are indicated with θ1 and θ2, respectively. Further, the first beam 511 and the second beam 521 have optical axes O1 and O2, respectively. These optical axis have a mutual angle indicated with γ.

The mutual distance between the light sources 10,20, which may also be indicated as shortest distance, is indicated with LD which is especially in the range of 5-200 mm. The shortest distance between the light sources and the redistribution foil is indicated with reference d1. Herein, the distance d1 is schematically depicted to be the same, though this is not necessarily the case. The shortest distance between the redistribution foils 100,200 and the redirection foil 300 is indicated with reference d2. The light sources are especially solid state light sources. Optionally, such light source may be a package of LEDs, like an RGB package. In such instance, the shortest distances between the LEDs in such LED package is especially equal to or smaller than 2 mm.

Reference 2 indicates a subunit including a first light source 100, its first redistribution foil 100, and the second light source, including its second redistribution foil. For instance, a lighting unit 1 may include a plurality of such units 2. Reference 3 indicates a further unit, comprising the former unit 2, but now including the redirection foil 300. Again, a lighting unit 1 may include a plurality of such units 3. Reference 5 indicates a control unit, which may optionally be including with the lighting unit, either integrated or remote, and which may especially be configured to control the light sources 10,20 individually. The first foil the rays hit when leaving the LED package can also be named the flux redistribution foil. The foil is applied to create a full illumination of the second foil. As we use two types of LEDs, the individual spectra from both types of LEDs should cover the complete area of the second foil such that at each position of the second foil a constant amount of light is delivered (in order to obtain a homogeneous exit window). However, as we use two colors we may e.g. require an alternating (e.g. checkerboard) pattern on a mesh grid that is sufficiently small spaced as to perceive it as uniform. This sets conditions on the beam spread of the individual beamlets from the facets of the first foil. The ideal intensity distribution required to obtain a uniform illumination is known and it's angular dependence is given by (1/cos θ)^3, e.g. the ratio of the flux for light travelling under 60° over the flux in normal direction is a factor 8. Angle β1 indicates the angle between the ray(s) of the first light source light 10 downstream of the first redistribution window 100 having the largest angle with the first optical axis O1; β2 indicates the angle between the ray(s) of the second light source light 20 downstream of the second redistribution window 200 having the largest angle with the second optical axis O2. These angles are thus especially 60° or smaller.

The typical facet size in a micro-optics design is ~50 um. If we apply a LED spacing of ~20 mm (LD) between two different colored LEDs the first foil has 20/0.05=400 individual facets in length direction available to deflect the rays. In case we position the first foil at a distance of 6 mm and in case we assume a LED area of 2 mm diameter the beam spread from the facets directly above the LED will be 20° while the beam spread of the beamlets at 10 mm from the centre of the foil will be 5°. This is indicated in FIG. 1A for the first light source 10, but this may also apply to the second light source.

This amount of beam spread is acceptable in case we use 2×2 $mm^2$ pixelated second foil at a distance of ~6 mm from the first foil. In case we would accept a coarser mesh for the second foil we could relax the beam spread conditions even further. Increasing the checkerboard pitch may possibly compromise the uniform appearance for the user/observer at some point (i.e individual 'pixels' would become visible).

As the spacing between a pixel located at the second foil directly above the LED and a pixel located directly above the (different colored) neighboring LED is 20 mm, the orientation of the beamlet becomes +/−2*60 degrees These deflection angles can be easily coped with (tilted) facets at the first foil. Using tilted facets the uniform illumination (of the second foil) requirement can be met as well: in order to correct for a lambertian source, we have to use 8 times more surface area of the first foil to illuminate the second foil under 60 degrees compared to 0 degrees. The application of the second foil is firstly to increase the beam width of both the white and blue colored beamlets: the target width for the white beamlets is 2*60° and for the blue 2*20-2*30°. In addition, the blue beamlets need to be redirected such that they exit the second foil under an angle of +/−75°. This rather large deflection angle can be straightforwardly achieved with facets that use total internal reflection. (Small deflections require facets that apply refraction, large deflection angles require total internal reflection. The overlap area (25-50° deflection) is most challenging due to the required high aspect ratio of the facets). Hence, with the alternating redirection regions, the first regions are distributed over the redirection window to allow a viewer to see a homegenously lighting exit window, providing the first beam of light, such as white light, and also with the alternating redirection regions, the second regions are distributed over the redirection window to allow a viewer to see a homegenously lighting exit window, providing the second beam of light, such as blue light.

In FIG. 1A a schematic view of multiple colored LED sources and two foils is displayed. The triangles indicate the beam spread and orientation of the beamlets. Since the LED has finite dimensions, it is not possible to steer the light leaving the optical element at a certain location precisely into a predetermined direction: the predetermined direction will be blurred into a range of directions. This range (also called beam spread) is due to the finite solid angle subtended by the LED source. In the arrangement as sketched, this beam spread will be about 20° right above the LED, reducing to 5° at the periphery of the optical element (the LED is 2 mm in size and located at a distance of 6 mm from an optical element that is 20 mm wide).

FIG. 1B schematically depicts and embodiment with the diffuser window 400, arranged downstream from the redirection window.

In this embodiment the functionality of the second foil can also be performed with a diffuser and a micro-optical foil. In this case the diffusing foil is the visible exit window and the micro facetted foil is used for beamlet redirection. One benefit for this configuration is that the uniform illumination requirement on the middle foil can be somewhat relaxed as it is no longer directly visible for the user. Note that optionally also the embodiment of FIG. 1A may include a diffuser window, such as with a very narrow FWHM.

Figure 1C:
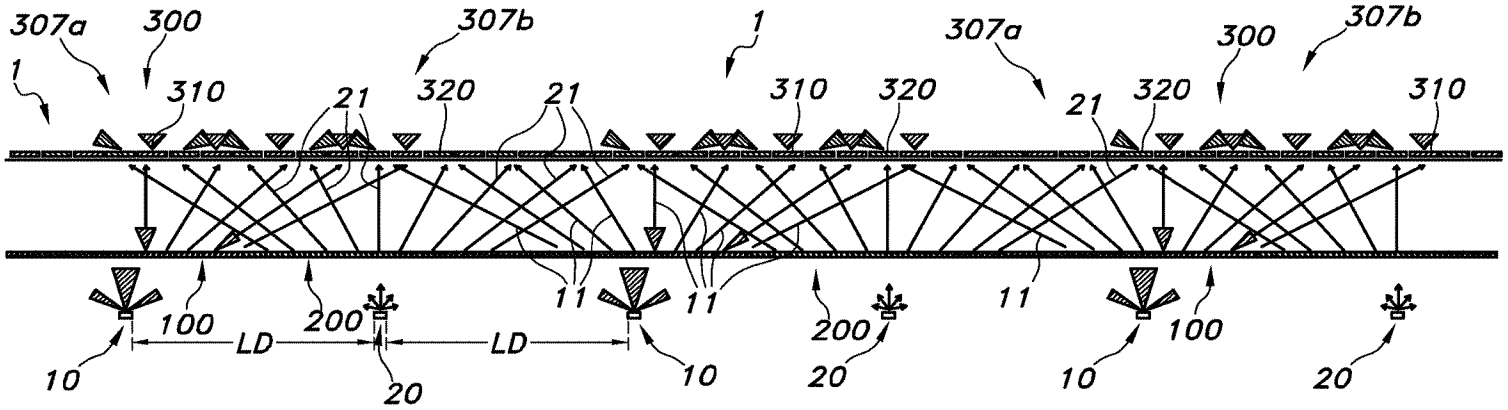

FIG. 1C schematically depicts an embodiment of the lighting unit 1 which schematically shows a plurality of first light sources 10, their redistribution windows 100, and their redirection window parts 307*a*, as well as a plurality of second light sources 20, their redistribution windows 200, and their redirection window parts 307*b*. Here, the redirection window may be a single window, with a plurality of redirection regions, with subsets of redirection regions for each light source (see also e.g. FIG. 2A). Further, the redistribution windows 100,200 may be a single window with redistribution regions, dedicated to the respective first light sources 10 and second light sources 20. Here, the redistribution windows 100,200 are depicted as single redistribution window extending over the entire set of light sources 10,20. For instance, both the redistribution window and the redirection window may be polymeric foils.

Figure 1D:
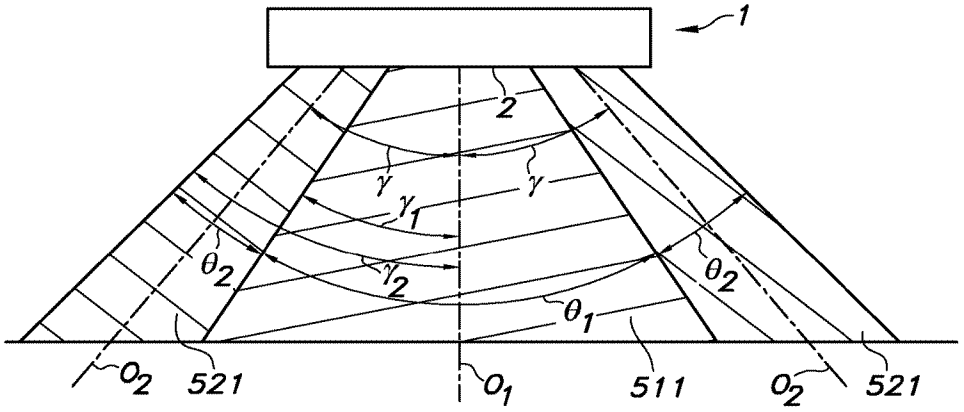
Figure 1E:
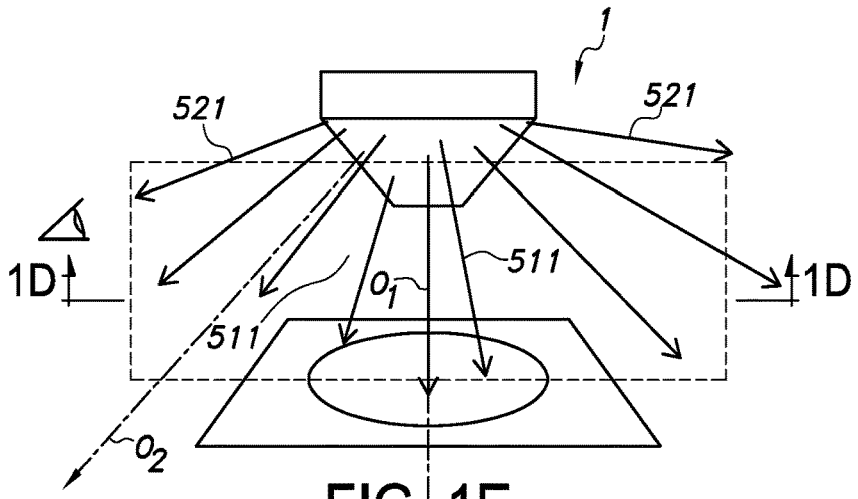

FIGS. 1D and 1E schematically depict the light escaping from embodiments of the lighting unit 1, such as schematically depicted in FIGS. 1A and 1B, with FIG. 1D being a side view and FIG. 1E being a perspective view. Note that a spectator under the lighting unit 1 may perceive e.g. white light beam 511 and when viewing from a side, may perceive e.g. blue light beam 521. Referring to FIG. 1D, which is a cross-section (or cross-sectional plane) of the beams 511, 521 (see also FIG. 1E), with the cross-section being parallel to the first optical axis O1 (and the cross-section including the first optical axis), it is noted that the description of the mutual angle γ of the first and the second optical axis may especially be defined in the context of such cross-section. Assuming a downlighter and 3D, typically the distribution could be rotationally symmetric around the central (vertical) axis (or have at least some form of rotational symmetry around O1 (e.g. 90° rotation axis (square symmetry); 45° rot axis (hexagonal symmetry), etc.). In 3D, the second optical axis may be even considered to be an optical plane. Hence, the second beam 521 may also be defined with respect to the first optical axis O1, with the second beam 521 being found between a first angle γ1 and a second angle γ2 relative to the first optical axis O1, with γ1<γ2, and with especially γ1≥30°, even more especially γ1≥45°, yet even more especially γ1≥60°, and with especially γ2≤90°. Again, the beams are especially defined with respect to the FWHM. In this cross-sectional view of the beams 511,521, it also appears that the second beam 521 has a kind of batwing distribution, with optical axis O2 in a single plane having a mutual angle 2*γ. Referring to FIGS. 1D and 1E, it can be seen that in the far field the beams 511,521 only partly overlap, or do not overlap.

Figure 1F:
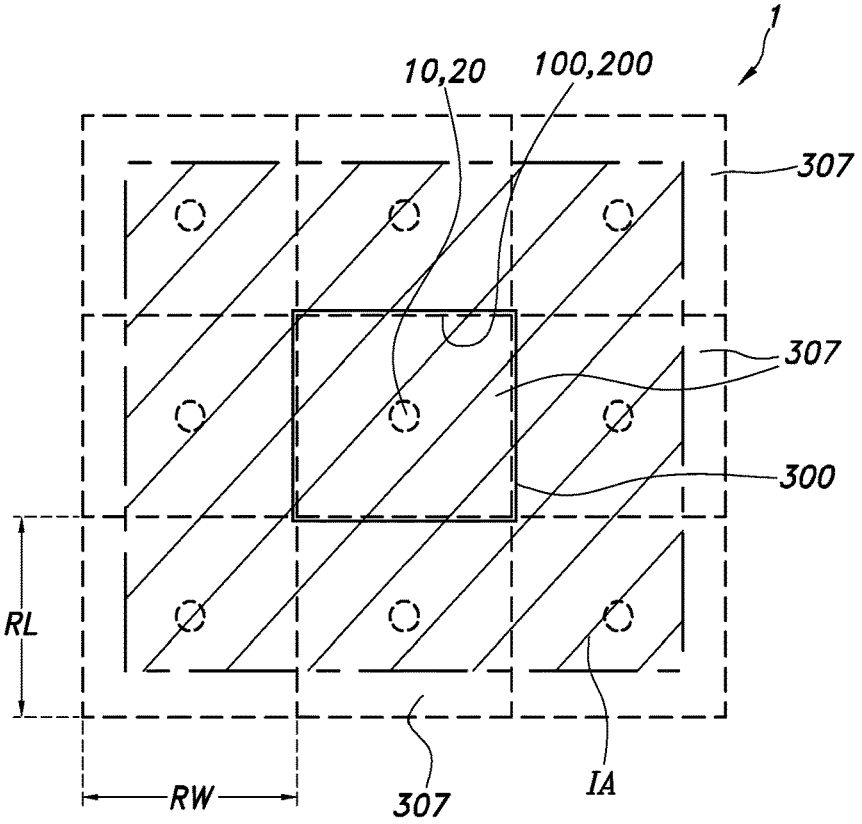

FIG. 1F schematically depicts a top view of an embodiment of the lighting unit 1. The optional diffuser window is not depicted (for the sake of simplicity). The full line indicates a redirection window part 307. The dashed squares surrounding this central redirection window part 307 are redirection window parts associated with adjacent light sources, which are indicated with the small dashed squares at each center. The dashed square within the solid square is just added to indicate the redistribution window behind the plane of drawing, and arranged between the light source (10,20) and the redirection window part 307. The larger dashed area indicates the area that is illumination by the light source via the redistribution window 100,200, and clearly extends to the adjacent redirection window parts 307. This illuminated area is indicated with reference IA. References RL and RW indicate the length and width of the redirection window parts, which may be in the range of e.g. 20*20 $mm^2$. In case the light sources 10,20 are arranged in a cubic arrangement as the redirection window(s) (parts) will in general have such symmetry, like depicted in FIG. 1F.

Figure 2A:
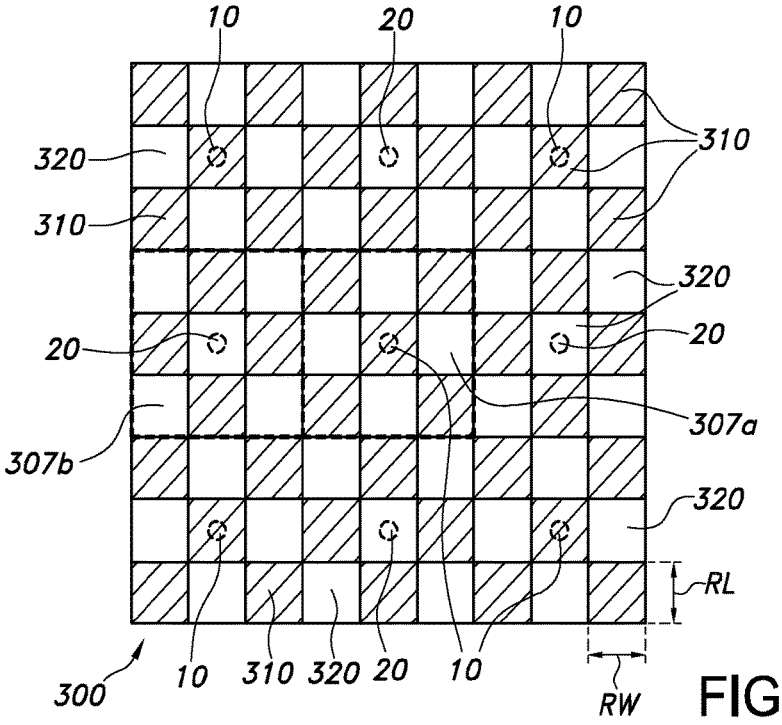
FIGS. 2A-2E schematically depicts some aspects and variants of the lighting unit and elements thereof.

FIG. 2A schematically depict an embodiment of the redirection window 300, with a checker board patter of the first and second redirection regions 310,320, respectively. By way of example, in this schematic embodiment each light source has 9 downstream arranged redirection regions (4-5 first redirection regions and 5-4 second redirection regions). In practice, this will be more, suc as at least 16, like at least 25, or even at least 100.

Figure 2B:
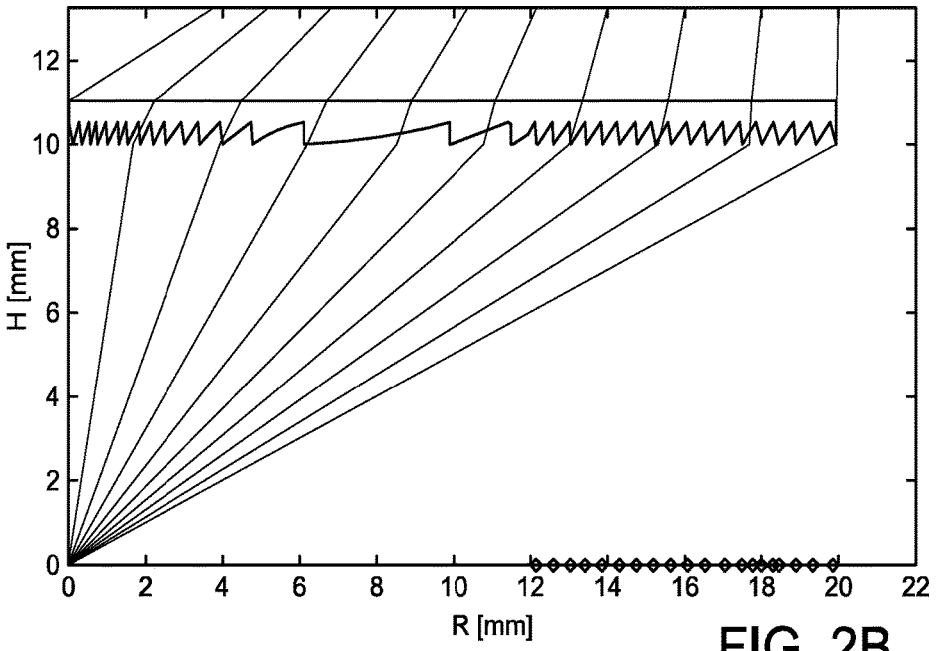
Figure 2C:
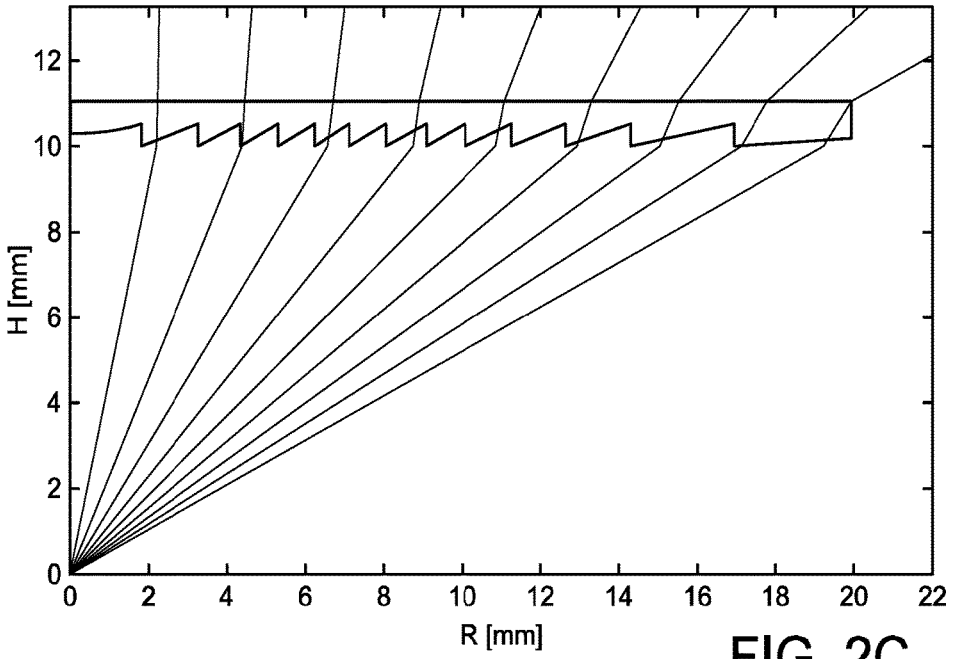

FIG. 2B-2C schematically depict embodiments of structures that may be used to redistribute or redirect the light source light. Different structures may be chosen. Here, by way of example Fresnel type of structures are depicted.

Figure 2D:
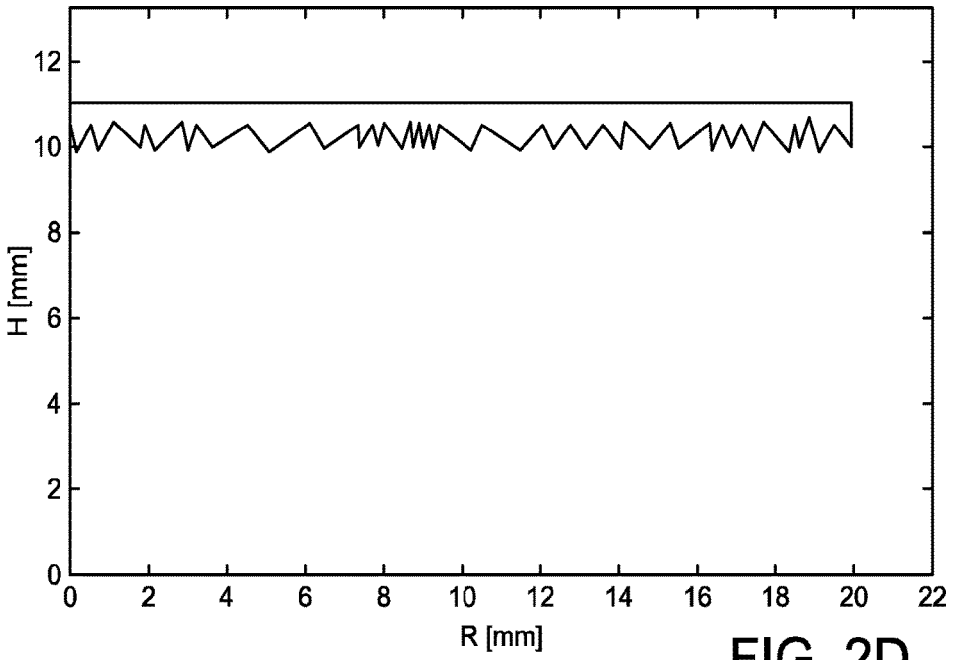

FIG. 2D schematically depict an embodiment wherein e.g. prismatic structures are applied.

Figure 2E:
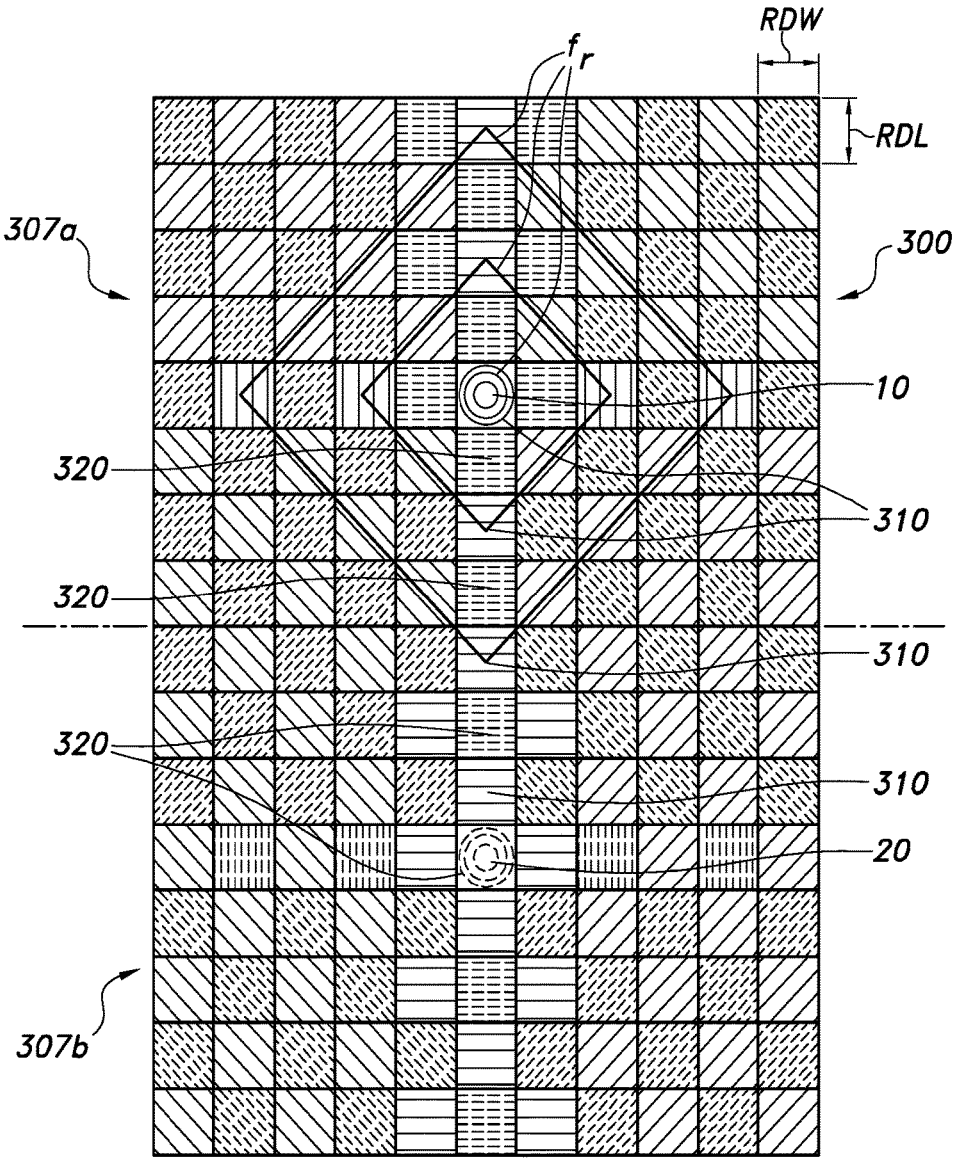

FIG. 2E schematically depicts an embodiment wherein the redirection window 300 comprises Fresnel lensens, that are arranged in a checkerboard arrangment, with Fresnel lens parts per each redirection region. Fresnel rings on the redirection window 300 are depicted as concentric rings with the annuli located directly above the first light source 10 and second light source 20, respectively. The example is given for one white and one blue (down) LED light source that fill the whole surface area of the redireciton window 300, i.e. two redirection parts 307*a* and 307*b*. In this schematic drawings, only the Fresnel rings directly downstream of the light source have been drawn with curves. However, also the Fresnel rings in the other redirection regions may be curved. Some of the Fresnel rings associated with the first light source 10 are indicated with reference fr. Note that instead of Fresnel rings also other micro optical structures may be used, such as prismatic structures. Also combinations may be used.

Figure 3A:
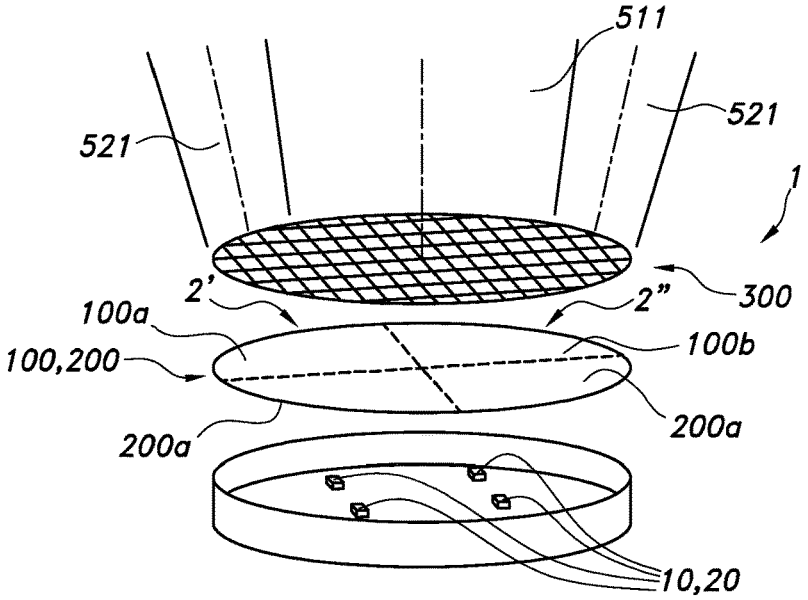
FIGS. 3A-3D schematically depicts some aspects and variants of the lighting unit and elements thereof.

FIG. 3A schematically depicts an embodiment of the lighting unit 1 comprising a plurality of first light sources 10 and a plurality of light source 20, a plurality of accompanying first redistribution windows 100, and a plurality of second redistribution windows 200. Here, by way of example two first light sources 10, with redistribution windows 100*a* and 100*b*, respectively, and two second light sources 20, with redistribution windows 200*a* and 200*b*, respectively, are depicted. In this way, for instance two units 2 may be provided, indicated with references 2' and 2". Note that the units may only redistribute light over the respective part of the redireciton window 300 or may redistribute over the entire redirection window 300 (i.e. to the respective first redirection regions and second redirection regions over the entire redirection window 300).

Figure 3B:
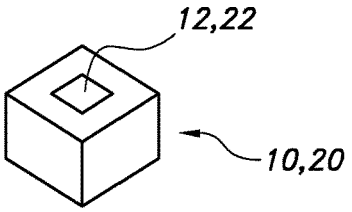
Figure 3C:
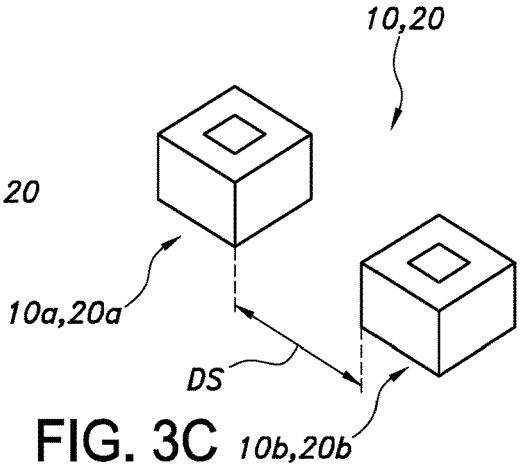

FIG. 3B-3C schematically depicts two embodiments of light sources 10,20. In the in FIG. 3B depicted embodiment, this may be a solid state light source with a die 12 or 22, depending whether this schematic drawing symbolized the first or the second light source. In in FIG. 3C, by way of example an embodiment of the first or the second light source is depicted, wherein such light source comprises a plurality of light sources (like a package). When the light source includes more than one light source, the distance DS will in general be small, such as less than 5 mm, especially less than 2 mm.

Figure 3D:
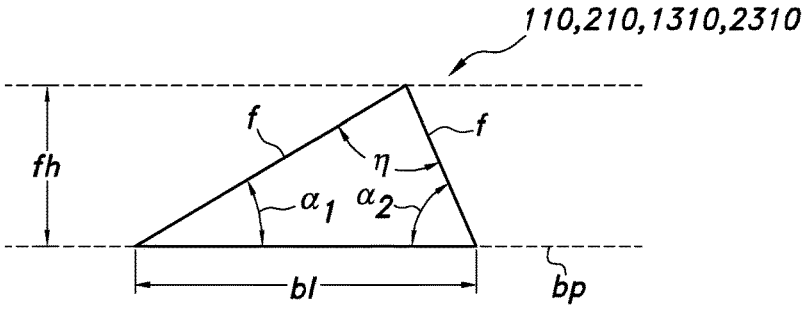

FIG. 3D schematically depicts a side view of (part of) an optical element, such as may be used at the redistribution windows 100,200 and in the first and second regions of the redirection window. Reference fh indicates the facet height and reference f indicates the facets; reference bp indicates the base plane, which will be parallel to the respective plane of the window; and refernce b1 indicates the base length. The base length will in general be in the range of 1-500 μm, especially in the range of 5-200 μm, such as 10-100 μm. Angle α1 indicates the base angle, and angle η indicates th top angle or mutual angle of the faces f.

The invention claimed is:

1. A lighting unit comprising: a first light source and a second light source configured to provide light source light having different spectral distributions, a light transmissive first light redistribution window configured downstream of the first light source and a light transmissive second light redistribution window configured downstream of the second light source, a light transmissive redirection window configured downstream of the first light redistribution window and the second light redistribution window, and optionally a diffuser window configured downstream of the light transmissive redirection window, wherein the first light redistribution window is configured to redistribute first light source light of the first light source over the light transmissive redirection window to a plurality of first redirection regions of said light transmissive redirection window; and wherein the second redistribution window is configured to redistribute second light source light of the second light source also over the light transmissive redirection window to a plurality of second redirection regions of said light transmissive redirection window;

the first redirection regions of the light transmissive redirection window, optionally in combination with the diffuser window, are configured to shape at least part of the received first light source light into a first beam of light; and the second redirection regions of the light transmissive redirection window, optionally in combination with the diffuser window, are configured to shape at least part of the received second light source light into a second beam of light, wherein the first beam of light and the second beam of light do not overlap or only partly overlap, and wherein the first beam of light and the second beam of light have different spectral distributions.

2. The lighting unit according to claim 1, wherein the first light source and the second light source are arranged at a light source distance (LD) selected from the range of 5-200 mm.

3. The lighting unit according to claim 1, wherein the first redirection regions of the light transmissive redirection window optionally in combination with the optional diffuser window are configured to provide in a cross-sectional view said first beam of light having a first optical axis and having a first opening angle selected from the range of 60-150°, wherein the second redirection regions of the light transmissive redirection window, optionally in combination with the diffuser window are configured to provide said second beam of light having second optical axis and having a second opening angle selected from the range of 5-60°, and wherein the first optical axis and the second optical axis have a mutual angle (γ) selected from the range of 45-90°.

4. The lighting unit according to claim 1, wherein:

the light transmissive first light redistribution window comprises first redistribution optical elements, wherein the light transmissive second light redistribution window comprises second redistribution optical elements;

each first redirection region comprises one or more first redirection optical elements, and wherein each second redirection region comprises one or more second redirection optical elements, the first redistribution optical elements are configured to redirect the first light source light to the plurality of first redirection regions, the second redistribution optical elements are configured to redirect the second light source light to the plurality of second redirection regions, wherein the first redirection optical elements optionally in combination with the optional diffuser window are configured to provide said first beam of light having a first optical axis and having a first opening angle selected from the range of 60-150°, wherein the second redirection optical elements are configured to provide said second beam of light having second optical axis and having a second opening angle selected from the range of 5-60°.

5. The lighting unit according to claim 3, wherein a diffusor foil is applied, and wherein the diffuser window has a full width half maximum (FWHM) selected from the range up to 30°.

6. The lighting unit according to claim 3, wherein first redistribution optical elements, the second redistribution optical elements, the first redirection optical elements, the second redirection optical elements, comprise optical elements with facets (f) having facet heights (fh) selected from the range of 10-5,000 μm and have base angles (α) of the facets (f) with a base plane of the layers independently selected from the range of 50-80° and 10-40°.

7. The lighting unit according to claim 1, wherein the first light redistribution window the light transmissive second light redistribution window independently comprise Fresnel lenses, and wherein the first redirection regions and the second redirection regions independently comprise at least part of Fresnel lenses.

8. The lighting unit according to claim 1, wherein the first redirection regions and the second redirection regions are configured in an arrangement wherein the regions alternate.

9. The lighting unit according to claim 1, wherein the first redirection regions and the second redirection regions are configured in a checkerboard pattern, and wherein the first light redistribution window, the second light redistribution window, and the redirection window comprise polymeric foils.

10. The lighting unit according to claim 1, wherein:

the first light redistribution window and the second light redistribution window are arranged at a first distance selected from the range of 1-50 mm of the respective light sources;

the redirection window is arranged at a second distance selected from the range of 1-200 mm of the first light redistribution window and the second light redistribution window; wherein the first redirection regions and the second redirection region having cross-sectional areas of less than 20 $mm^2$;

the first light source and the second light source are solid state light sources having light emitting surfaces having areas selected from the range of 0.25-100 $mm^2$.

11. The lighting unit according to claim 1, wherein the first light source is configured to generate white first light source light and wherein the second light source is configured to provide one or more of blue and red second light source light.

12. The lighting unit according to claim 1, further comprising a control unit, configured to control the first light source and the second light source independently.

13. The lighting unit according to claim 1, comprising a plurality of first light sources and a plurality of second light sources, wherein the first light sources and second light sources are configured in an arrangement wherein the light sources alternate, wherein downstream from each first light source the first light redistribution window is configured, wherein downstream from each second light source the second light redistribution window is configured, wherein downstream of each of the first light distribution window a first part of the light transmissive redirection window is configured, wherein downstream of each of the second light distribution window a second part of the light transmissive redirection window is configured, wherein each first part and second part comprises a plurality of redirection regions, wherein first light sources and first light distribution windows are configured to redistribute the first light source light over their first part of the light transmissive redirection window and also at part of one or more adjacent second parts of the light transmissive redirection window, and wherein second light sources and second light distribution windows are configured to redistribute the second light source light over their second part of the light transmissive redirection window and also at part of one or more adjacent first parts of the light transmissive redirection window.

14. The lighting unit according to claim 13, wherein the first light sources and the second light sources in combination with the redistribution windows are configured to illuminate the redirection window homogeneously.

15. Use of the lighting unit according to claim 1, in an indoor environment for providing daylight experience for a human.

* * * * *